US007272869B1

(12) United States Patent
Robinson

(10) Patent No.: US 7,272,869 B1
(45) Date of Patent: Sep. 25, 2007

(54) ERGONOMIC MULTI-FUNCTIONAL CLEANING MACHINE

(75) Inventor: Robert S. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 568 days.

(21) Appl. No.: 10/685,259

(22) Filed: Oct. 14, 2003

Related U.S. Application Data

(60) Provisional application No. 60/417,907, filed on Oct. 11, 2002.

(51) Int. Cl.
*A47L 11/30* (2006.01)

(52) U.S. Cl. ..... 15/320; 15/321

(58) Field of Classification Search ..... 15/320, 15/321, 323
See application file for complete search history.

(56) References Cited

U.S. PATENT DOCUMENTS

| | | | | |
|---|---|---|---|---|
| 983,293 | A | 2/1911 | Kundig-Honegger | |
| 1,363,860 | A | 12/1920 | Fetters et al. | |
| 2,184,731 | A | 12/1939 | Brewer | |
| 2,531,370 | A | 11/1950 | Thompson | |
| 3,431,582 | A | 3/1969 | Grave | |
| 3,662,427 | A | 5/1972 | Hanna | |
| 3,909,197 | A | 9/1975 | Cremers | |
| 3,977,039 | A | 8/1976 | Block | |
| 4,062,085 | A | 12/1977 | Duncan | |
| 4,320,555 | A | 3/1982 | Watson | |
| 4,329,756 | A * | 5/1982 | Chicoine et al. | 15/321 |
| 4,397,057 | A * | 8/1983 | Harbeck | 15/321 |
| 4,696,074 | A * | 9/1987 | Cavalli | 15/321 |
| 4,809,397 | A | 3/1989 | Jacobs et al. | |
| 4,825,501 | A | 5/1989 | Ashby et al. | |
| 4,826,514 | A | 5/1989 | Griffis | |
| 4,934,017 | A | 6/1990 | Kent | |
| 5,146,647 | A | 9/1992 | Blase et al. | |
| 5,189,755 | A * | 3/1993 | Yonkers et al. | 15/321 |
| 5,263,223 | A * | 11/1993 | Fiegel et al. | 15/321 |
| 5,465,456 | A * | 11/1995 | Fellhauer et al. | 15/320 |
| 5,526,547 | A | 6/1996 | Williams et al. | |
| 5,657,509 | A | 8/1997 | Trautloff et al. | |
| 5,907,887 | A * | 6/1999 | Mansur | 15/320 |
| 6,014,790 | A | 1/2000 | Smith et al. | |
| 6,206,980 | B1 | 3/2001 | Robinson | |
| 2001/0000576 | A1* | 5/2001 | Robinson | 134/169 C |
| 2002/0116783 | A1* | 8/2002 | Giddings et al. | 15/321 |
| 2003/0159230 | A1* | 8/2003 | Oh | 15/320 |

OTHER PUBLICATIONS

Definition of "spigot" from WEBSTER's New World Dictionary, Third College Edition, Copyright 1988.*

* cited by examiner

*Primary Examiner*—Terrence R. Till
(74) *Attorney, Agent, or Firm*—David E. Pritchard

(57) ABSTRACT

The ergonomic multi-functional cleaning machine includes a fresh liquid tank, a waste recovery tank positioned atop the fresh liquid tank, and a vacuum source for enabling a soil-containing fluid to be vacuumed into the waste recovery tank. The machine further includes: (1) a fresh liquid pump positioned above the fresh liquid tank, with the fresh liquid pump enabling a liquid or solution to be pumped from the fresh liquid tank; and/or (2) a spigot operatively connected to the fresh liquid tank, whereby a user may regulate the flow of a liquid or solution from the fresh liquid tank. Also, the machine may include an inline wetting apparatus, thereby providing for vacuuming of dry dirt, dust, and other soils.

42 Claims, 7 Drawing Sheets

ERGONOMIC MULTI-FUNCTIONAL CLEANING MACHINE

CROSS-REFERENCE TO RELATED APPLICATION

This patent document claims the benefit of the filing date of Provisional U.S. Patent Application No. 60/417,907 entitled "Ergonomic Multi-Functional Cleaning Machine" and filed on Oct. 11, 2002. The entire disclosure of that provisional U.S. patent application is incorporated into this patent document by reference.

BACKGROUND OF THE INVENTION

1. Field of the Invention

This invention is directed to multi-functional cleaning machines, and in particular, to multi-functional cleaning machines for use in commercial, industrial, institutional, and public buildings.

2. Description of the Related Art

Maintaining the cleanliness of commercial, industrial, institutional, and public buildings is an ongoing effort, and at times, an effort which seems more like a losing battle. This is particularly true for areas such as restrooms, locker rooms, stairwells, cafeterias, and food service kitchens, where the volume of traffic in the particular area may make it difficult to maintain the cleanliness of the facility.

Building maintenance staff typically clean such areas on a routine basis using traditional mop-and-bucket assemblies, in which the bucket includes a detachable mop wringer, and is positioned on caster wheels, thereby enabling a building maintenance person to move the mop bucket from place to place, typically by pushing on the mop handle. Depending on the cleanliness of the mop, a worker may be able to make a good start in cleaning a floor using the mop bucket system. However, as soon as the worker makes a first pass and wrings the mop out, the entire mop bucket system is contaminated. From that point on, each time the worker plunges the mop into the bucket and rings the mop out, both the mop and "cleaning water" become more and more dirty.

One way to attempt to solve this problem is to make frequent water and mop changes. However, this adds time to an already laborious process, and therefore, there is little worker incentive to make frequent water and mop changes. Moreover, because a slop sink, source of clean water, or custodial supply room may be far away, a worker is even less inclined to make water and mop changes.

The end result is that a dirty floor gets cleaned by pushing dirty water around with a dirty mop. At best, the surface may have the appearance of being cleaned if concentrated spots of highly visible soil have been removed or spread around. In reality, however, given the limitations of these tools, the worker still is simply pushing dirt around the floor, as evidenced by the "five o'clock shadow" of dirt seen frequently along the surface of walls adjacent the floor, as well as the finger-painting-like streaks left by the mop when the water on the floor dries.

The cleanliness problem may be especially severe in the restrooms of these various buildings, and in fact, the number-one building maintenance complaint is dirty restrooms. Given the frequency with which these facilities are used, as well as the tools available for cleaning restrooms, the dirty restroom complaint is not particularly surprising. Building maintenance workers typically use the mop-and-bucket system described above to clean restroom floors. And, as noted above, while this system may pick up some dirt, it tends more typically to spread dirty water around on the floor. In addition, restrooms have many surfaces, such as urinals, toilets, dividers, walls, mirrors, sinks, and counter tops, which simply cannot be cleaned using the mop-and-bucket approach. The tools for cleaning these surfaces, such as brushes, sponges, spray-bottle chemical disinfectants, cloth wipes, and the like, are extremely hands-on, and therefore, are less desirable to use. And, when chemical disinfectants solutions are used, generally a worker will spray the solution onto a surface, and wipe the solution off, either right away or within a few minutes. However, a chemical disinfectant typically must remain in contact with a surface for about ten minutes in order to kill bacteria. Accordingly, little, if any, chemical disinfecting actually is being done. Because these cleaning tools and methods are relatively unpalatable, building maintenance workers tend to clean these kinds of surfaces less frequently, and when they are cleaned, they are not cleaned thoroughly. The janitorial/sanitation ("Jan/San") industry offers other pieces of cleaning equipment, such as pressure washers, wet vacs, auto scrubbers, carpet extractors, pump-up sprayers, and janitor's carts. However, because of the limitations of several of these tools, as well as their single-task focus, sanitary maintenance professionals tend to use them in actual cleaning either infrequently, or not at all.

Most pressure washers operate at a pressure of 1000 PSI and above, a pressure which is far too high for many cleaning applications. For example, if such a pressure washer were use to mechanically clean a painted wall, it would blast the paint off of the wall surface. On the other end of the pressure spectrum are pressure washers having a pressure of about 100 PSI or less. And because of the type of pump used in these low pressure sprayers, the liquid exiting the sprayer actually has a far, far lower pressure, for example, about 40 PSI. Although such a low-pressure washer may be beneficial in applying a cleaning solution, it lacks the mechanical power required to actually clean a particular surface once the solution has been applied. Because pressure washers generally include a single clean-liquid water tank or container, both cleaning chemicals and water are loaded into this same container, which may be damaging to the device, particularly if a harsh cleaning chemical passes through a mechanical component, such as a pump. Because most pressure washers do not have there own water source, an operator must use a garden-type hose, and must have ongoing access to a corresponding faucet throughout the pressure washing process. Moreover, these pressure washers generally lack a convenient on-board storage system for storing the garden hose and power cord during transport.

Conventional wet-vacs provide a user with the ability to vacuum soiled cleaning solution from a floor. However, movement of these devices from place to place can be difficult because the vac hose, wand, and various tools typically must be carried independently of the wet-vac device. Furthermore, the drain outlet on such devices is designed for draining into a custodial slop sink, thereby requiring the user to take the wet-vac to a particular location in order to drain the device.

Pump-up sprayers also are available, which enable a sanitation maintenance worker to sprinkle a cleaning solution under low-pressure onto a particular surface. In addition, the Jan/San Industry provides various mobile janitorial carts, which may include storage shelves for various supplies, as well as a frame for a trash bag.

As is apparent from the discussion of the various cleaning tools presented above, janitorial/sanitation professionals have a variety of tools from which to choose. However, these tools are either inadequate to do a proper cleaning job, or are so task-specific that they become user-unfriendly, given the many aspects involved in proper building maintenance. Accordingly, given the relative ineffectiveness and/or inefficiency of the various tools available, particular facilities are not cleaned as well or as frequently as they should be, and morale and job satisfaction among many building maintenance professionals are relatively low.

SUMMARY OF THE INVENTION

The present invention overcomes the above-mentioned drawbacks by providing an integrated ergonomic multi-functional cleaning machine which is suitable for use in any of a number of different building maintenance applications.

To this end and in accordance with the principles of the invention, one aspect of the invention is an ergonomic multi-functional cleaning machine having a fresh liquid tank, a waste recovery tank positioned atop the fresh liquid tank, a vacuum source for enabling a soil-containing fluid to be vacuumed into the waste recovery tank, and a fresh liquid pump positioned above the fresh liquid tank, with the fresh liquid pump enabling a liquid or solution to be pumped from the fresh liquid tank. If desired, this machine optionally may include a fresh liquid pump positioned above the fresh liquid tank, as discussed in further detail below.

Another aspect of the invention is an ergonomic multi-functional cleaning machine having a fresh liquid tank, a waste recovery tank positioned atop the fresh liquid tank, a vacuum source for enabling a soil containing fluid to be vacuumed into the waste recovery tank, and a spigot operatively connected to the fresh liquid tank, thereby enabling a user to regulate the flow of a liquid or solution from the fresh liquid tank. If desired, this machine optionally may include a fresh liquid pump positioned above the fresh liquid tank, as discussed in further detail below.

A further aspect of the invention is an inline wetting apparatus fluidly connectable to the waste recovery tank of an ergonomic multi-functional cleaning machine. The inline wetting apparatus includes tubing having a first end, a second end, a circumferential sidewall defining an interior, and a rim defining an opening in the circumferential sidewall. The first end of the tubing is fluidly connectable to a cleaning tool, and the second end of the tubing is fluidly connectable to the waste recovery tank. The inline wetting apparatus also includes a spray assembly which is fluidly connectable to the rim of the tubing and to a source of pressurized liquid. The spray assembly includes a spray nozzle and mounting structure, with the spray assembly being operable to direct a liquid through the spray nozzle into the interior of the tubing from a source of pressurized liquid. The mounting structure is releasably connectable to the rim of the tubing, thereby providing a user with access to the interior of the tubing via the opening defined by the rim when the mounting structure is disconnected from the rim. Given the structure of the inline wetting apparatus, a liquid from the spray nozzle and soil particles which are passing through the tubing may come into contact with one another.

Each of the machines offers several benefits and advantages to a user. For example, because the waste recovery tank is positioned atop the fresh liquid tank, and the fresh liquid pump is positioned above the fresh liquid tank, the machine occupies only a relatively small amount of floor space, while providing a large amount of cleaning capacity. Also, the inline wetting apparatus is of tremendous benefit to a user. In particular, when the wetting apparatus is hooked up, a user may perform dry vacuuming without a dirt collection bag, thereby further extending the range of the ergonomic multi-functional cleaning machine into yet another realm of cleaning.

If desired, the machine may include pump priming structure fluidly connected to the fresh liquid pump. The pump priming structure may include a manually operated primer bulb and/or a user activated valve. If desired, the machine may further include a motor housing connected to the waste recovery tank, with the motor housing defining a motor housing interior space. Typically, the vacuum source includes a vacuum motor, in which case the vacuum motor may be positioned in the motor housing interior space and mounted to the motor housing. Also, if a fresh liquid pump is included, the pump may be positioned in the interior space and mounted to the motor housing, as well. In addition, if desired, the motor housing may include a generally upwardly extending projection, and the fresh liquid tank may include a generally downwardly extending projection, with the projections constructed and arranged to serve as upper and lower hose wraps, respectively.

As mentioned briefly above, the cleaning machine may include a spigot operatively connected to the fresh liquid tank, thereby enabling a user to regulate the flow of a liquid or solution from the fresh liquid tank. If desired, the spigot may have a selectively adjustable valve which is operable between a fully open position and a fully closed position. The cleaning machine, itself, includes a back, and if desired, the spigot may be positioned at the back of the machine. In another aspect, the machine may include an extension handle operatively connected to the spigot, with the handle being elongated and extending upwardly from the spigot. The handle is particularly beneficial to a user, in that it allows a user to control the spigot valve from a point which is further up from a floor or other horizontal surface on which the machine rests. Also, the extension handle makes it quite easy for a user to simultaneously steer the machine and adjust the spigot valve. This feature comes in handy when a user wants to apply a liquid, cleaning solution, floor finish, or the like, in a controlled manner from the spigot to a floor surface.

In another aspect, the cleaning machine includes waste recovery intake structure, with the waste recovery intake structure being fluidly connected to, and extending generally upwardly from, the waste recovery tank. If desired, the waste recovery intake structure may be integrally connected to the waste recovery tank. The intake structure further may include an upper portion fluidly connected to a lower portion, with the upper portion extending generally outwardly from the waste recovery tank. Also, the upper portion of the intake structure may include a waste recovery intake port, in which case the intake port may include a tube. In this manner, when the vacuum source is activated, a soil containing fluid may flow upwardly through the tube, across an interior space of the upper portion, downwardly through the lower portion, and into the waste recovery tank. If desired, the waste recovery intake structure may be generally positioned toward and at the front of the machine. In a further aspect, the machine may include a generally outwardly and downwardly extending projection positioned at the front, below the waste recovery intake structure, whereby the intake structure and the projection may serve as upper and lower hose wraps, respectively. In this fashion, a user easily may stow a length of vacuum hose on the machine, simply by looping the hose around the wrap projection and intake assembly. In another aspect, the waste recovery intake structure may include a circumferential sidewall defining an interior passage, and the cleaning machine may include a filter positioned in the interior passage.

In a further aspect, the waste recovery tank may include a discharge outlet. If desired, the discharge outlet may be from about 12 inches to about 18 inches above a floor or other horizontal support surface, as measured when the machine is positioned in an upright orientation on the particular horizontal support surface. This feature is particularly beneficial, in that, given the height of the discharge outlet above the ground, a user may drain the contents of the waste recovery tank directly into a toilet bowl, which oftentimes may be much more readily accessible than a slop sink or floor drain located in a remote janitor's closet.

In yet another aspect, the cleaning machine may include a forced air source distinct from the working-air discharge of the vacuum source. This forced air source may include a blower motor which, if desired, may be positioned in the motor housing interior space and mounted to the motor housing. When the machine includes a blower motor, a user quickly and easily may connect a blower tool assembly to an outlet of the forced air source, thereby providing a user with yet another source of forced air for blow drying or any other suitable purpose.

With regard to the inline wetting apparatus mentioned above, it too may have additional aspects and features. If desired, the mounting structure and the rim may be adapted to form a friction fit with one another. In this fashion, a user readily may connect and disconnect the mounting structure and the rim—a feature which is particularly advantageous. For example, depending on the specific positioning of the spray nozzle, the feature may allow a user to quickly and easily inspect the orifice and tubing interior, and if necessary, to clean off either or both of these components. In a further aspect, the tubing may include a releasably connectable tube section, with the tube section including the rim which defines the opening in the circumferential sidewall of the tubing. Also, at least a portion of the tubing may be flexible, and at least a portion of the tubing may be transparent or translucent. When the inline wetting apparatus is connected to the ergonomic multi-functional cleaning machine, the source of pressurized liquid for the apparatus may include the fresh liquid tank and the fresh liquid pump of the cleaning machine. The inline wetting apparatus provides an extended area or zone for contact between a liquid or solution from the spray nozzle and the many soil particles which are being drawn through the tubing due to the suction being provided from the vacuum source.

The various aspects of the invention discussed briefly above combine to provide an effective and efficient, ergonomic, multi-functional cleaning machine, one that is useful in cleaning numerous areas in and around commercial, industrial, institutional, and public buildings. Moreover, because the various aspects of the invention allow a building maintenance worker to clean a particular room or facility more effectively, and to do so without having to touch soiled surfaces directly with the hands, the invention actually provides an incentive for these workers to do a thorough cleaning job, and even assists in boosting worker morale. These and other benefits and advantages of the invention will be made apparent from the accompanying drawings and description of the drawings.

BRIEF DESCRIPTION OF THE DRAWINGS

The accompanying schematic drawings, which are incorporated in, and constitute a part of, this specification, illustrate versions of the invention and, together with the general description of the invention given above, and the detailed description of the drawings given below, serve to explain the principles of the invention.

DETAILED DESCRIPTION OF THE DRAWINGS

Figure 2:
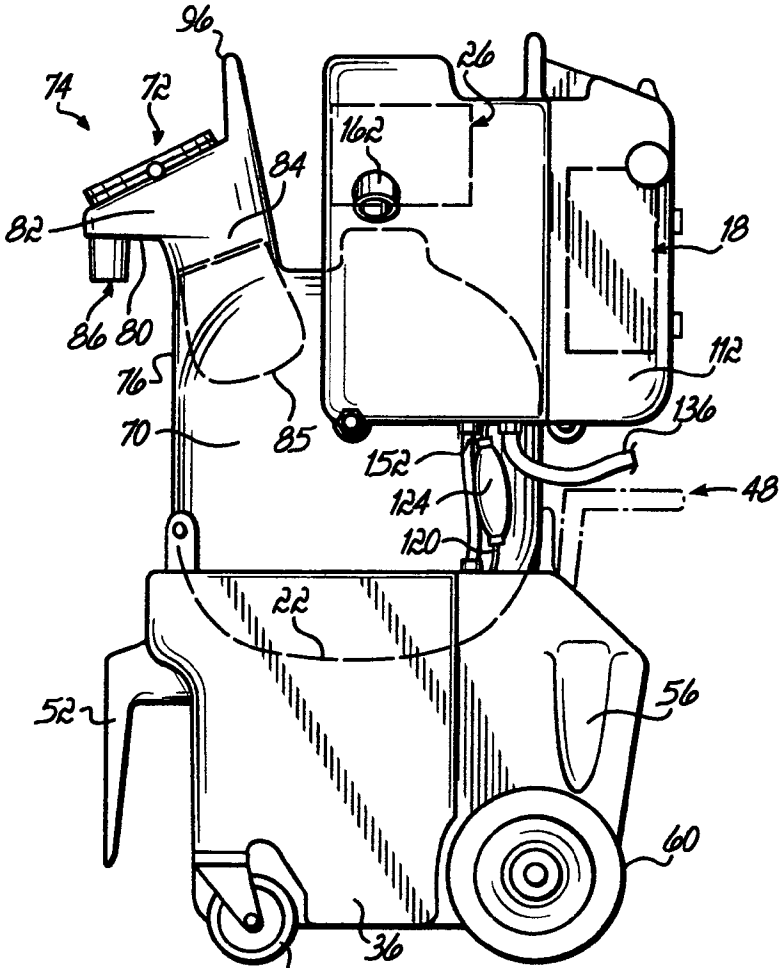
FIG. 2 is an elevated left side view of the version of the machine shown in FIG. 1.

With reference to FIGS. 1-6, an ergonomic multi-functional cleaning machine 10, in accordance with the principles of the invention, includes a fresh liquid tank 12, a waste recovery tank 14 positioned atop the fresh liquid tank 12, a vacuum source in the form of a vacuum assembly 16 for enabling a soil-containing fluid to be vacuumed into the waste recovery tank 14, and a fresh liquid pump 18 positioned above the fresh liquid tank 12, the fresh liquid pump 18 enabling a liquid or solution to be pumped from the fresh liquid tank 12.

In further detail, the fresh liquid tank 12 has a top wall 20, a portion of which is generally concave; and the waste recovery tank 14 has a bottom wall 22, a portion of which is generally convex, corresponding substantially with the generally concave portion of the top wall 20 of the fresh liquid tank 12. Accordingly, with this particular machine 10, the waste recovery tank 14 not only is positioned "atop" the fresh liquid tank 12, but more precisely, a significant portion of the waste recovery tank bottom wall 22 rests on, and is supported by, the corresponding portion of the fresh liquid tank top wall 20.

A motor housing 24 is mounted to the waste recovery tank 14. The motor housing 24 contains the vacuum assembly 16, the fresh liquid pump 18, a separate forced air source in the form of a blower assembly 26, and several of the fluid and electrical lines. The motor housing 24 also has a control panel 28 for operating the various electromechanical components contained within the motor housing 24, and is described in further detail below.

Figure 4:
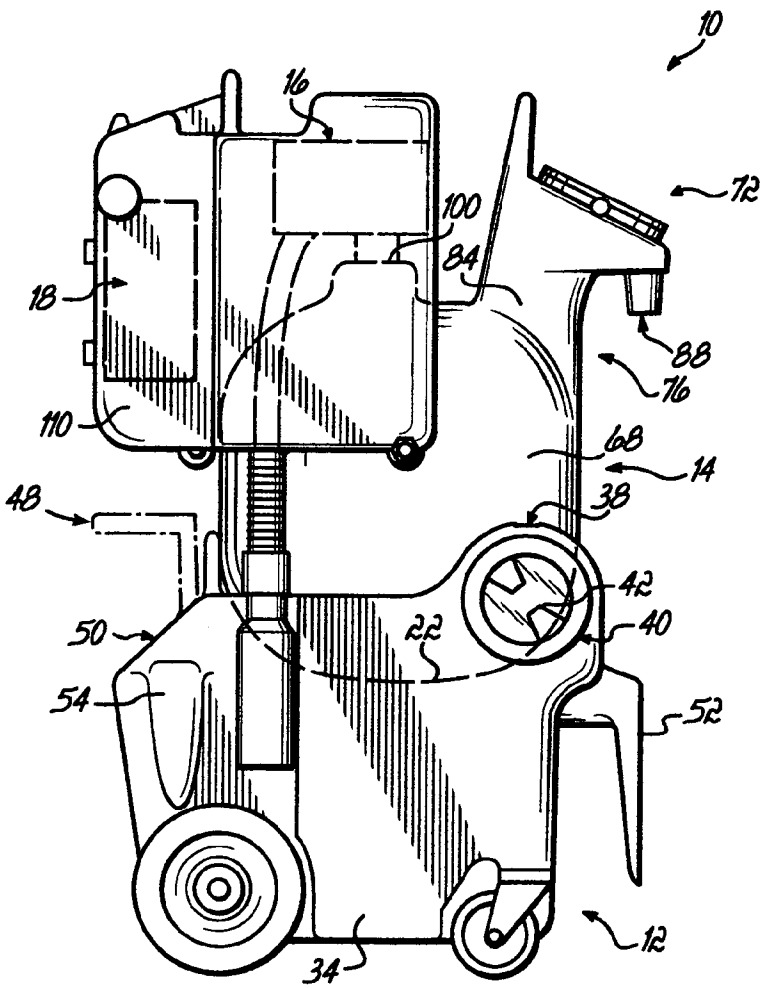
FIG. 4 is an elevated right side view of the version of the machine shown in FIG. 1.

The fresh liquid tank 12 has a front wall 30, back wall 32, right sidewall 34, left sidewall 36, top wall 20, and bottom wall (not shown). As seen in FIG. 4, the right sidewall 34 includes a fill port 38 through which a user may add a liquid or solution into the fresh liquid tank 12. If desired, the liquid or solution may be easily and conveniently added using a Universal Fill Hose (not shown) available from Kaivac Inc. of Hamilton, Ohio. The Universal Fill Hose is described in further detail in U.S. Pat. No. 6,431,217 entitled "Liquid Transport Device" and issued on Aug. 13, 2002. The right sidewall 34 further includes an auxiliary access port 40 adjacent the fill port 38. The auxiliary access port 40 includes a transparent removable and resealable cover 42. The fill port 38 and the access port 40 provide a user with multiple ways to view and determine the level of a liquid or solution in the fresh liquid tank 12. In addition, because the transparent cover 42 of the access port 40 is removable, a user may use either the fill port 38 or the access port 40 as a point of entry into the interior of the fresh liquid tank 12, in the event a user wants to rinse out the fresh liquid tank 12.

Figure 3:
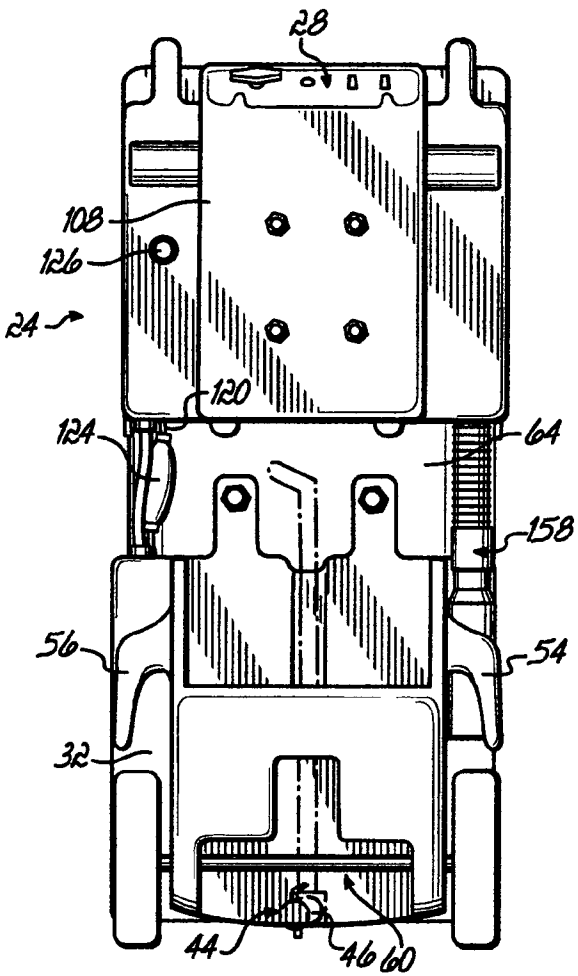
FIG. 3 is an elevated back view of the version of the machine shown in FIG. 1.

As shown in FIG. 3, the machine 10 optionally includes a spigot assembly 44 (shown in phantom) extending outward from the back wall 32 of the fresh liquid tank 12. The spigot assembly 44 includes a spigot 46 and a length of tubing (not shown). The tubing is connected at one end to the spigot 46, and at the other end to the interior of the fresh liquid tank 12, adjacent the bottom wall of the tank 12. In addition, the machine includes an optional extension handle 48 (shown in phantom), with the lower end of the handle being connected to the spigot 46. Note that, even if the extension handle 48 is omitted, the spigot assembly 44 may be included. For the sake of clarity, in the text below, the ergonomic multi-functional cleaning machine 10 without the extension handle 48 is designated 10*a*; whereas the machine 10 with the extension handle 48 is designated 10*b*.

For both machines 10*a*, 10*b*, the spigot 46 has an outlet which is oriented downward, in the direction of a horizontal support surface, for example, a floor. The spigot 46 has a selectively adjustable valve which is operable between a fully opened position and a fully closed position. In this fashion, a user may selectively adjust the spigot valve, thereby regulating the flow of a liquid or solution out of the fresh liquid tank 12. The spigot assembly 44 offers a great deal of flexibility to a custodian or other user. For example, if a user simply wants to empty the contents of the fresh liquid tank 12, the user may position the spigot outlet over a floor drain and open the spigot valve, thereby draining the contents of the fresh liquid tank 12. Also, as shown in FIGS. 1-4 and described in further detail below, the multi-functional cleaning machine 10 includes wheels, and therefore, is highly mobile. Accordingly, a user may push or pull the machine 10, while simultaneously applying a liquid or solution from the fresh liquid tank 12 onto a floor or other horizontal support surface.

The extension handle 48, which is connected to and extends upwardly from the spigot 46, further enhances the overall ergonomic design of the multi-functional cleaning machine 10*b*. The elongated stem of the handle 48 extends upward through an opening (not shown) in a storage compartment 50 at the back of the machine 10*b*. A gripping portion is integrally connected to the stem at an angle, thereby allowing a user to selectively adjust the spigot valve from a far greater height than the location of the spigot 46, itself. The gripping portion is particularly advantageous for a user who wants to apply a liquid or solution to a floor while simultaneously moving the machine 10*b* along the floor. By way of non-limiting example, a custodian or other user may want to use the machine for routine floor cleaning, grout cleaning, floor degreasing, floor stripping, applying floor finish, or the like. In any of these situations, machine 10*a* may be used. However, if a custodian or other worker wants to apply a liquid or solution directly from the fresh liquid tank 12 onto a particular floor surface while simultaneously moving the machine, the worker may find it easier to use machine 10*b*, including the extension handle 48, to assist in regulating flow from the spigot 46, as the user guides the machine 10*b* along a desired path across the particular floor.

Other aspects of the fresh liquid tank 12 include a hose wrap projection 52 extending out and down from the front wall 30, a hose wrap projection 54 extending out and down from the right sidewall 34, a hose wrap projection 56 extending out and down from the left sidewall 36, a pair of caster wheels 58 mounted to the bottom wall toward the front of the machine, and a fixed-axle rear-wheel assembly 60 mounted in the right and left sidewalls 34, 36 toward the back of the machine. Although each of the various wrap projections of the invention typically is referred to as a hose wrap projection, any given projection or pair of corresponding projections may be used to support and/or stow any suitable length of material, with non-limiting examples including a vacuum hose, a power cord, and a high pressure liquid hose.

The waste recovery tank 14 includes a front wall 62, a back wall 64, a top wall 66, a bottom wall 22, a right sidewall 68, and a left sidewall 70. Waste recovery intake structure in the form of a waste recovery intake assembly 72 extends upwardly and outwardly from the tank 14, adjacent the front and top walls 62, 66. In further detail, the intake assembly 72 has an upper portion in the form of a head portion 74 fluidly connected to a lower portion in the form of a neck portion 76, with the neck portion 76 fluidly connecting the head portion 74 to the waste recovery tank 14. The head portion 74 has a top wall 78, a bottom wall 80, and a circumferential sidewall 82, with the sidewall 82 integrally connected to a circumferential sidewall 84 of the neck portion 76. With reference to FIG. 2, the circumferential sidewalls 82, 84 define an interior passage, and a removable reusable filter 85 is releasably positioned in the interior passage. Advantageously, the filter may be sized so as to capture relatively large pieces of debris (for example, pencils and scraps of paper), while allowing air and soiled liquid or solution to pass through the filter 85. The filter 85, itself, may be formed of any suitable materials. For example, a mesh pouch may be connected to a circumferential band, with the band defining the opening of the particular filter. Depending on the size of the band, the band may form a releasable friction fit with the interior surface of one or both of the circumferential sidewalls 82, 84. Alternatively, one or more of the sidewalls 82, 84 may include an inward projection, inward projections, flange, or the like, on which the band of the particular filter may be releasably seated.

The bottom wall 80 of the head portion 74 includes a waste recovery intake port in the form of a tube 86 which extends generally downward from the bottom wall 80. The tube 86 is sized so as to form a secure yet releasable friction fit with one end of a length of a vacuum hose. At the same time, the tube 86 is fluidly connected to the interior of the waste recovery tank 14 via the interior of the waste recovery intake assembly 72. The bottom wall 80 of the head portion 74 also has a generally downwardly extending post 88 which is adjacent the tube 86. However, the post 88 is not fluidly connected to the interior of the waste recovery tank 14. Instead, the post 88 is sized to form a secure yet releasable friction fit with an outlet end of a dumping hose (described in further detail below), when the dumping hose is in a stowed position.

The top wall 78 of the head portion 74 includes a viewing window in the form of an access port 90 and a transparent removable and resealable cover 92. Because the cover 92 is transparent, a user may see materials as they enter into the waste recovery tank 14, and also may see the level of the waste material in the recovery tank 14. Also, with the cover 92 removed, a user may remove, rinse, and replace the filter 85. In addition, if desired, a user may choose to rinse the interior of the recovery tank 14 by spraying water or the like through the access port 90 onto the interior surface of the tank 14.

The circumferential sidewall 82 of the head portion 74 further has several projections extending outward. In further detail, a pair of posts 94*a,b* extends outward in a substantially horizontal orientation from the circumferential sidewall 82 of the head portion 74, adjacent the top wall 78. One of the posts 94*a* extends from the right side of the circumferential sidewall, while the other post 94*b* extends from the left side. These posts 94*a,b* may be used in any of a number of different ways. For example, any item having a strap of a suitable length may be hung from the machine 10, simply by positioning a portion of the strap behind each of these posts 94*a,b*. The head portion 74 further has a tab 96 which extends upwardly from a back region of the head portion 74. Depending on the length of vacuum hose used with the machine 10, the tab 96 may assist in retaining the upper portion of coiled loops of the vacuum hose in a "pocket" formed by a back wall region of the head and neck portions 74, 76, the top wall 66 of the waste recovery tank 14, and a front wall 98 of the motor housing 24.

Figure 6:
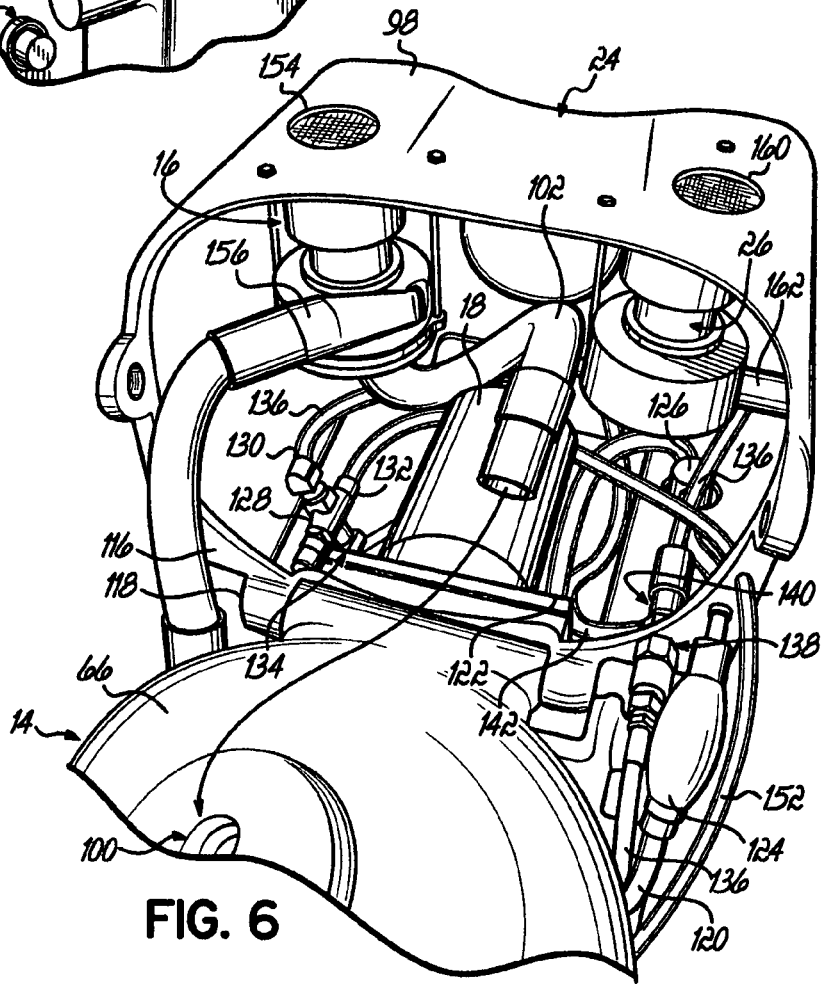
FIG. 6 is a perspective view of a portion of the version of the machine shown in FIG. 1.

With reference to FIGS. 2, 4, and 6, the waste recovery tank 14 further has a suction outlet 100 which is fluidly connected both to the waste recovery intake port tube 86 and the vacuum assembly 16. This suction outlet 100 is oriented along the top wall 66 of the waste recovery tank 14, and is adapted to releasably and securely connect with a length of suction hose 102 (FIG. 6) which leads from the waste recovery tank 14 to the vacuum assembly 16 (discussed in further detail below). Also, the interior of the waste recovery tank 14 includes a float shutoff mechanism (not shown) mounted to the interior surface of the top wall 66, adjacent the suction outlet 100. In this fashion, once a soiled solution in the recovery tank 14 reaches a particular level, the shutoff mechanism closes the suction outlet 100, thereby preventing any soil-containing solution from being drawn into the vacuum assembly 16.

As seen in FIGS. 2 and 4, the suction outlet 100 and the waste recovery intake assembly 72 are oriented so that a soiled solution which is vacuumed into the recovery tank 14 via the recovery intake port tube 86 tends to be deflected downward toward the bottom of the interior space of the recovery tank 14, and therefore, away from the suction outlet 100. In addition, as may be seen in FIGS. 2, 4, and 6, the portion of the recovery tank top wall 66 in which the suction outlet 100 is formed is elevated relative to the surrounding region of the top wall 66. Because this portion of the top wall 66 is elevated, the float shutoff mechanism in the waste recovery tank 14 also may be elevated, thereby increasing the useful capacity of the tank 14.

Figure 1:
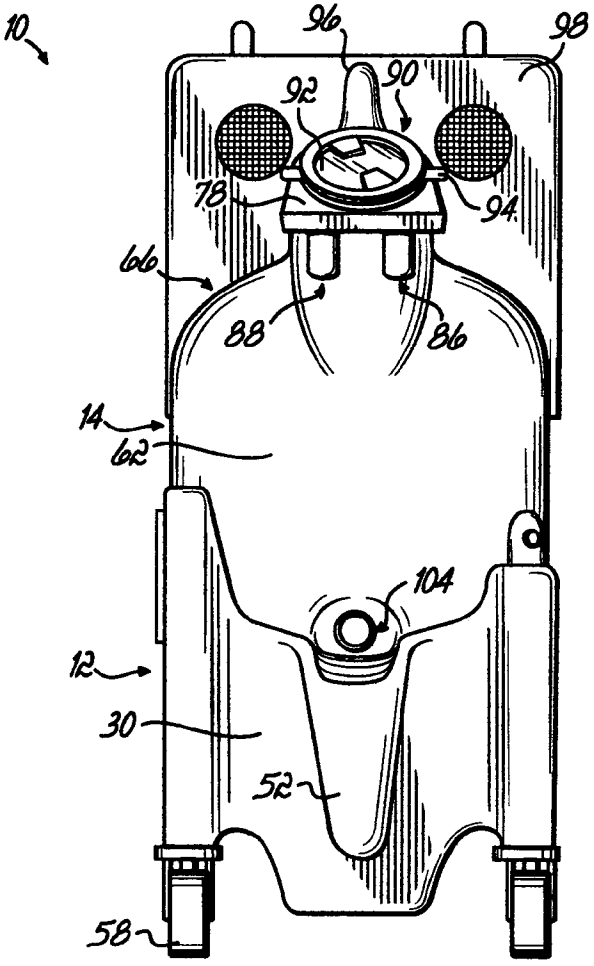
FIG. 1 is an elevated front view of a version of the ergonomic multi-functional cleaning machine in accordance with the principles of the invention.

As seen in FIG. 1, the waste recovery tank 14 also has a dumping outlet 104 formed in the front wall 62 adjacent the base. The inlet end of a dumping hose (not shown) is releasably connected to the dumping outlet 104, with the outlet end releasably secured to the post 88, as described above.

The motor housing 24 has a front wall 98, back wall 108, right sidewall 110, left sidewall 112, top wall 114, and bottom wall 116. As described briefly above, the motor housing 24 is mounted to the waste recovery tank 14, and contains the various electromechanical components of the ergonomic multi-functional cleaning machine. In further detail, the motor housing 24 is releasably mounted to the recovery tank 14, thereby providing qualified service personnel with ready access to the interior of the motor housing 24.

The electromechanical components of the multi-functional cleaning machine may be any suitable commercially available components. For example, if desired, the fresh liquid pump 18 may be a Series 112V pump, a Model 205 pump, or a Model M33 pump, all of which are available from Pump Tech Inc., Minneapolis, Minn. Also, if desired, the vacuum assembly 16 may be a Model 116472-29 vacuum assembly and the blower assembly 26 may be a Model 116207-00 assembly, both of which are available from the Lamb Electric Division of Ametech Inc., Kent, Ohio. The Series 112V pump is rated at ⅔ gallons per minute (GPM) and 250 pounds per square inch (PSI), the Model 205 pump is rated at one GPM and 400 PSI, and the Model M33 pump is rated at ¼ GPM and 200 PSI. The Lamb Electric vacuum assembly is rated at 112 cubic feet per minute (CFM) and 107 inches water lift, and the Lamb electric blower assembly is rated at 65.3 CFM and 40.8 inches water lift.

Figure 5:
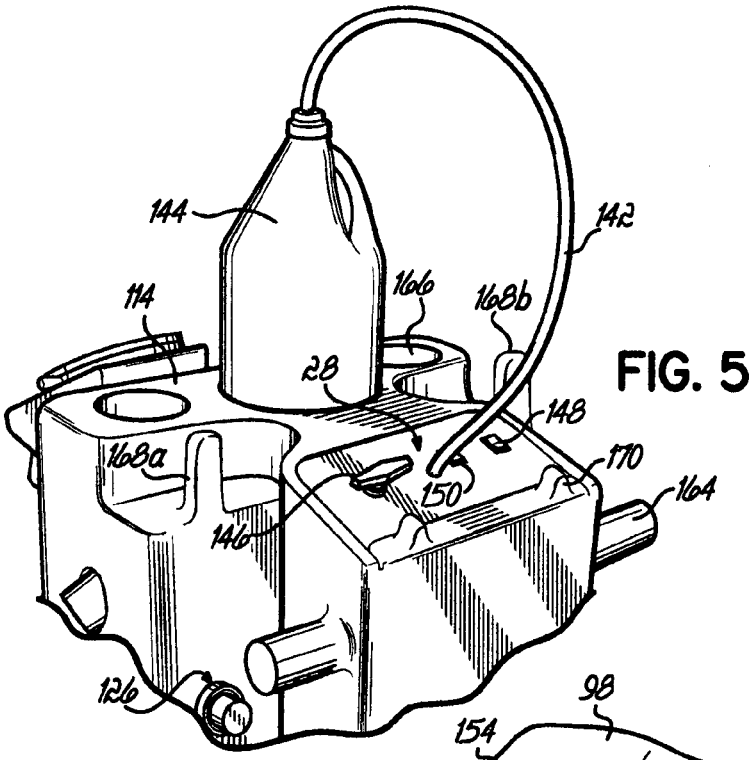
FIG. 5 is a perspective view of a portion of the version of the machine shown in FIG. 1.

For the particular multi-functional machine 10 shown in FIGS. 1-6, the pump 18, vacuum assembly 16, and blower assembly 26 are connected to other parts of the machine as described below. With reference to FIGS. 2, 3, and 6, a liquid feed line 120 extends from the fresh liquid tank 12, through an opening in the liquid tank top wall 20 adjacent the left sidewall 36, through an opening in the bottom wall 116 of the motor housing 24, to an inlet 122 on the pump 18. If desired, a length of metal tubing (not shown) may be positioned in the lumen of the liquid feed line 120, adjacent the inlet end (not shown) of the line 120. Such metal tubing may serve as a weight, and as a shape-retainer, thereby preventing the inlet end from curling. Both the weighting- and shape-retaining-aspects may assist in keeping the inlet end of the line 120 at or near the bottom of the tank. A length of the liquid feed line 120 which extends between the fresh liquid tank opening and the motor housing opening is readily accessible to a user. This length of line 120 includes pump priming structure in the form of an inline primer bulb 124 which contains a one-way check valve. In this fashion, if desired, a user may prime the pump 18 by squeezing the primer bulb 124 several times. The liquid feed line 120 includes an inline filter 126 in the section of the feed line 120 which extends from the primer bulb 124 to the pump assembly inlet 122. As seen in FIGS. 3, 5, and 6, an opening is formed in the back wall 108 of the motor housing 24, and a portion of the inline filter 126, including a transparent removable and resealable filter window, extends through that opening. In this fashion, a user easily may remove the plastic window cap and metal mesh filter positioned beneath the cap, thereby enabling easy cleaning of the inline filter 126. Once the metal mesh filter has been cleaned, a custodian or other user simply reinserts the filter and resecures the cap.

A fitting 128 having a primary outlet 130 and an unloader outlet 132 is connected to the pump outlet 134. A liquid discharge line 136 is connected to the primary outlet 130 and securely mounted to a portion of the bottom wall 116 of the motor housing 24, where it continues down from the exterior of the motor housing bottom wall 116, for connection with a spray gun, an inline wetting apparatus, or other device (not shown) which may benefit from a pressurized liquid or cleaning solution.

An inline fitting 138 mounts the liquid discharge line 136 securely to the portion of the bottom wall 116 of the motor housing 24, and includes a chemical injector 140. With reference to FIGS. 5 and 6, a chemical draw line 142 runs from a container 144 which is positioned atop the motor housing 24, through the top wall 114 of the motor housing 24, to the injector 140, thereby enabling a user to combine the contents of the container 144 with the liquid or solution being pumped from the fresh liquid tank 12. The container 144 itself has a metering tip (not shown), and the chemical draw line 142 has complementary quick disconnect members (not shown) along the section of the line 142 leading from the container 144 to the motor housing 24. The section of the chemical draw line 142 from the container 144 to the injector 140 has an inline on/off valve (not shown). As best seen in FIG. 5, this valve is operable by a handle 146 on the control panel 28. These various features enable a user to selectively adjust the rate at which a particular chemical enters the liquid discharge line 136 from the container 144. As also shown in FIG. 5, the control panel includes a first rocker switch 148 for turning the pump 18 on and off, and a second rocker switch 150 for selectively operating either the vacuum assembly 16 or the blower assembly 26, or for turning off both assemblies 16, 26.

The length of the liquid discharge line 136 which extends from the primary outlet 130 to the fitting 138 advantageously may be formed of a length of pulse hose. In this fashion, the pulse hose absorbs much of the pressure fluctuations which otherwise would be absorbed by the pump 18 and other mechanical components.

A liquid return line 152 extends from the unloader outlet 132, through an opening in the bottom wall 116 of the motor housing 24, and downward to an opening in the top wall 20 of the fresh liquid tank 12. At this point, the liquid return line 152 extends toward the bottom of the fresh liquid tank 12.

Figure 7:
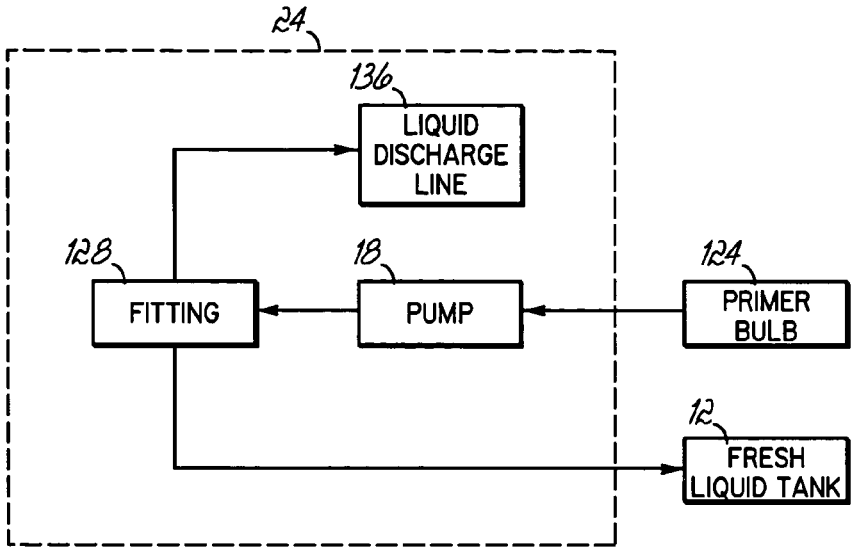
FIG. 7 is a diagram of one version of pump priming structure and several adjacent components, in accordance with the principles of the invention.

With reference to FIG. 7, the pump priming structure described above in connection with FIGS. 2, 3, and 6 is shown diagrammatically. This particular version of the pump priming structure includes the inline primer bulb 124 which is positioned outside the motor housing 24. As shown in FIG. 7, the inline primer bulb 124 is connected to both the fresh liquid tank 12 and the pump 18. A fitting 128 also is connected to the pump 18, with the fitting 128 being operable to direct a liquid or solution to the liquid discharge line 136 and/or back to the fresh liquid tank 12. In this configuration, the primer bulb 124, in essence, pushes any residual air out of the pump 18 and liquid feed line (not shown) during the priming process.

Figure 8:
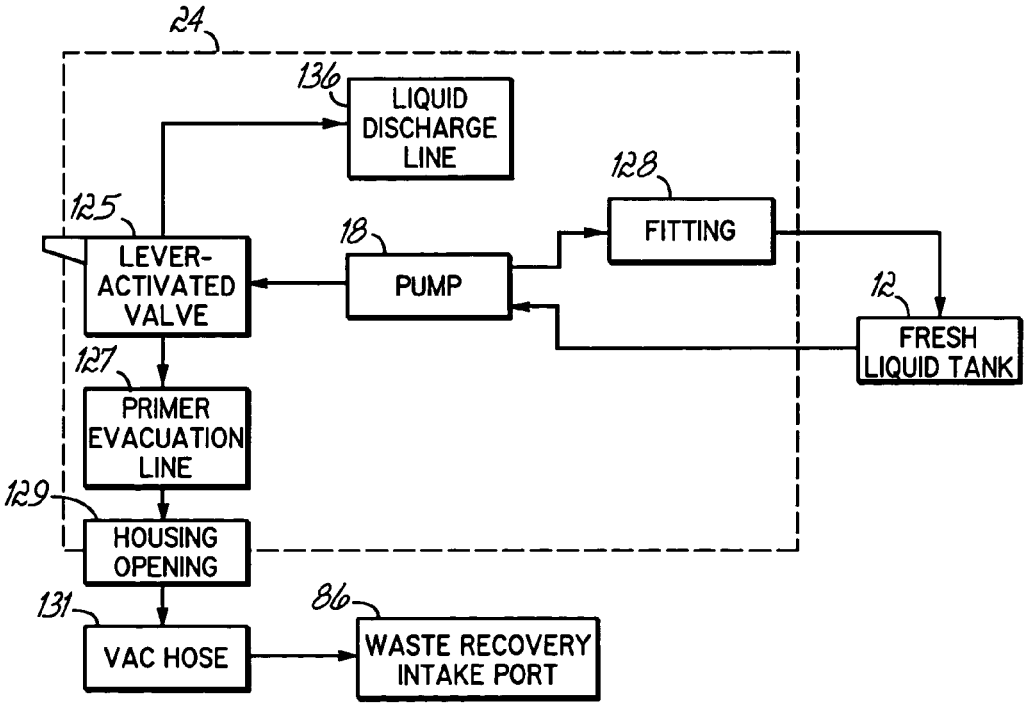
FIG. 8 is a diagram of another version of pump priming structure and several adjacent components, in accordance with the principles of the invention.
Figure 10:
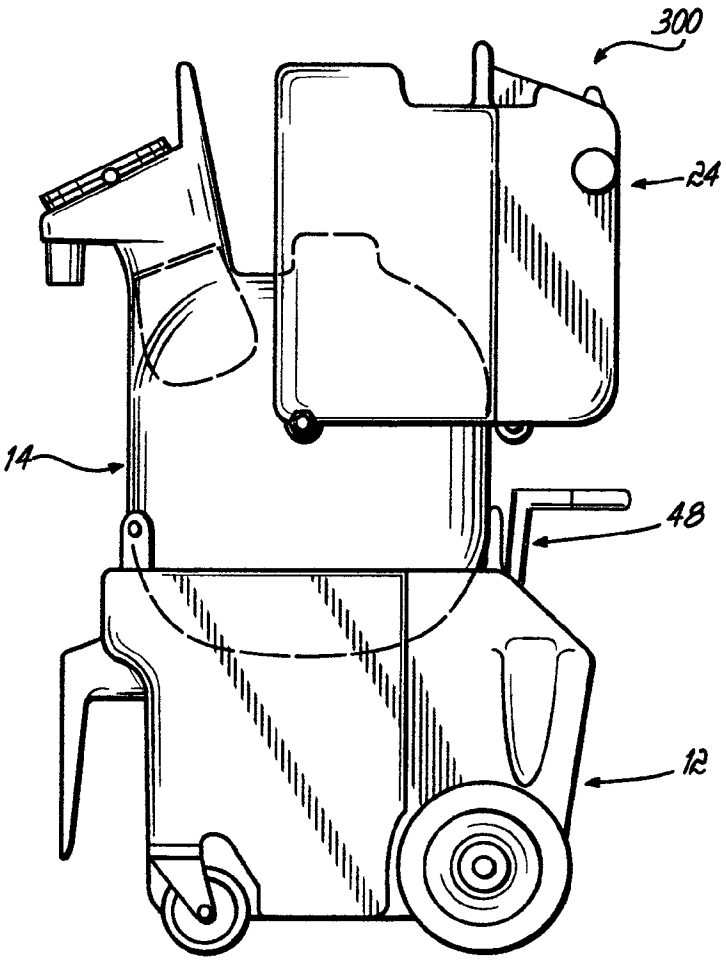
FIG. 10 is an elevated left side view of the version of the machine shown in FIG. 9.
Figure 9:
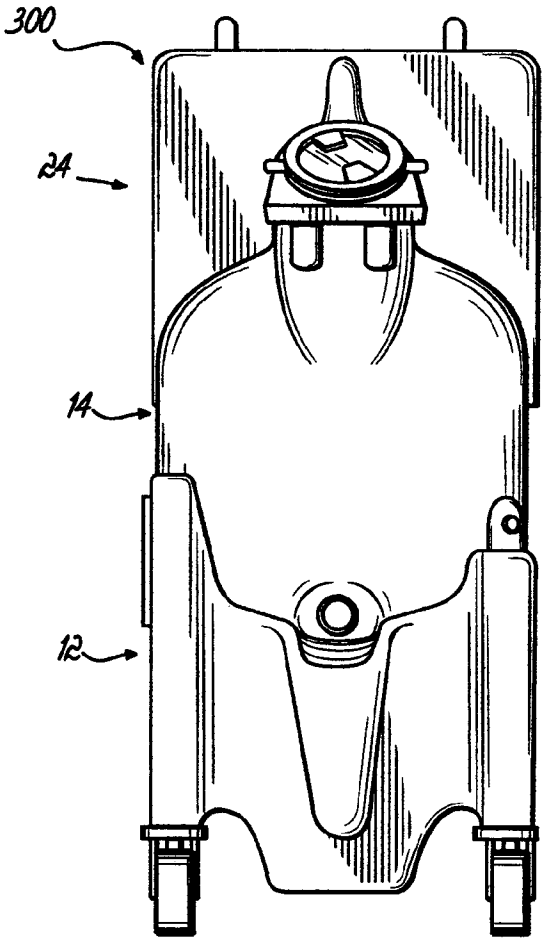
FIG. 9 is an elevated front view of another version of the ergonomic multi-functional cleaning machine in accordance with the principles of the invention.
Figure 12:
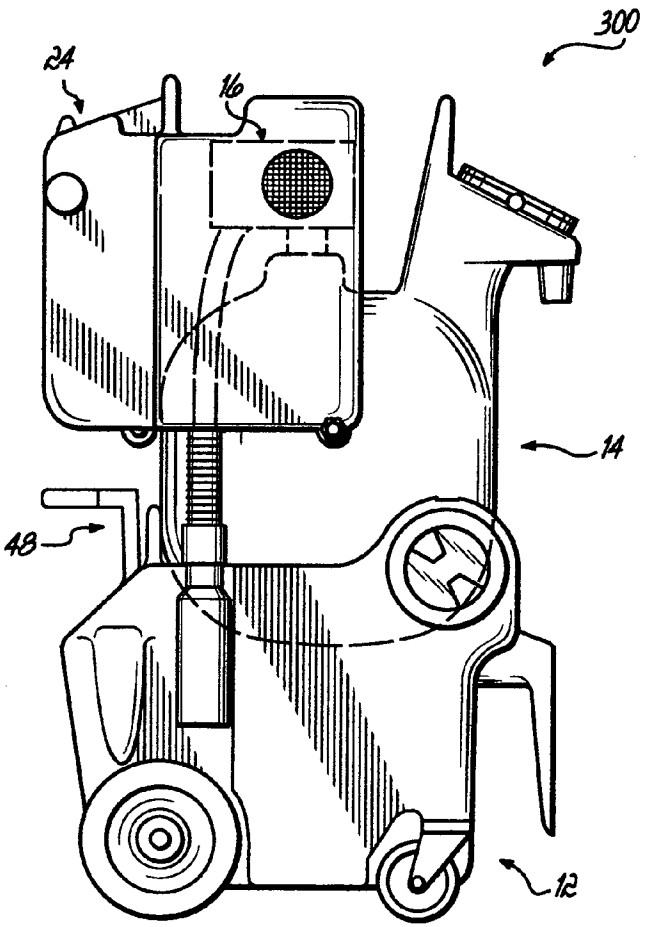
FIG. 12 is an elevated right side view of the version of the machine shown in FIG. 9.
Figure 11:
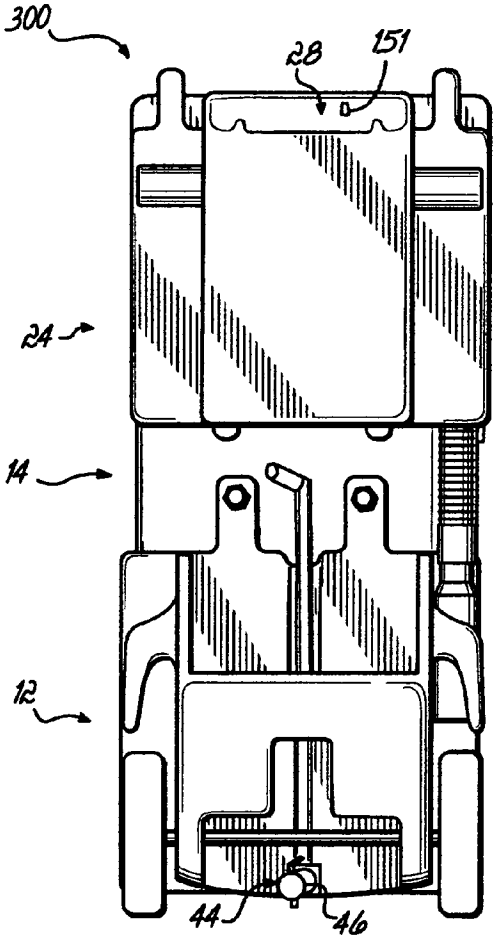
FIG. 11 is an elevated back view of the version of the machine shown in FIG. 9.

With reference to FIG. 8, another version of the pump priming structure may include an assembly of components which, in effect, pull any residual air out of the pump 18. In this version, a spring loaded lever activated valve 125 is connected to an outlet (not shown) of the pump 18. As shown schematically in FIG. 8, an end portion of the valve 125 extends outside the motor housing 24, for easy access and activation by a user. Within the motor housing 24, the valve 25 is connected to a primer evacuation line 127, and the line 127 is connected to an opening 129 in the motor housing upper wall. In order to create the priming pull action, a length of vac hose 131 may be releasably connected to the opening 129 and to the waste recovery intake port 86. In this configuration, the pump 18 also is connected to the fresh liquid tank 12 and to the fitting 128, with the fitting 128 being operable to deliver a liquid or solution to the liquid discharge line 136 and/or back to the fresh liquid tank 12. In this fashion, a user may prime the pump 18 by releasably connecting the vac hose 131 to the opening 129 and intake port 86, and also turning on the vacuum motor (not shown). Then, depending on the particular valve 125 being used, an operator simply pushes down or lifts up on the outer end of the valve lever, thereby creating an evacuating suction at the pump 18 which removes any residual air from the pump 18 and liquid feed line (not shown). If desired, the valve 25 may be the V4N valve from the Production Metal Forming Company of Klamath Falls, Oreg., although any suitable valve or valve assembly may be used. Also, if desired, the machine 10 may include the pump priming components of both FIG. 7 and FIG. 8.

As seen in FIG. 6, the vacuum assembly 16 is bolted directly to the front wall 98 of the motor housing 24. An opening 154 is formed in the front wall 98 adjacent the motor of the vacuum assembly 16. This opening 154 serves as an air intake, allowing cooling air to enter into, and thereby cool, the motor of the vacuum assembly 16. The opening 154 may be covered with a porous filter material which prevents large particles from entering into the motor. The vacuum assembly 16 further includes a suction conduit (not shown) and an exhaust conduit 156, with the suction hose 102 connected at one end to the suction conduit and adapted for secure yet releasable connection to the suction outlet 100 of the waste recovery tank 14. A muffler assembly 158 is securely and releasably connected to the exhaust conduit 156. If desired, the muffler assembly 158 may be detached from the exhaust conduit 156 and replaced with a blower assembly (not shown) such as, for example, a length of vacuum hose connected to a blower nozzle. In this fashion, the ergonomic multi-functional cleaning machine may be used to blow soil from a particular surface and/or to blow dry a particular surface.

Although the vacuum assembly 16 may serve as both a source of suction and a source of forced air, the multi-functional cleaning machine 10 shown in FIGS. 1-6 also includes an independent blower assembly 26. As with the vacuum assembly 16, the blower assembly 26 is mounted to the front wall 98 of the motor housing 24. An air intake opening 160 is formed in the front wall 98, adjacent the motor of the blower assembly 26, thereby providing an air intake for cooling air to enter into the motor housing of the blower assembly 26. This air intake likewise may be covered with a porous filter or screen in order to minimize the entry of particles into the motor housing. As shown in FIGS. 2 and 5, the exhaust conduit 162 of the blower assembly 26 extends outward through the left sidewall 112 of the motor housing 24, thereby making it extremely easy for a user to attach a length of hose and a blower nozzle (not shown) to the blower assembly 26.

Although a particular configuration of the vacuum assembly 16, pump assembly 18, and blower assembly 26 within the motor housing 24 has been described above in connection with FIG. 6, any suitable configuration may be used. For example, although not shown, the vacuum assembly may be mounted to the pump assembly, and the pump assembly may be mounted to a mounting plate. If desired, the mounting plate may be releasably secured to the interior surface of the back wall of the motor housing, and may include a vibrationreducing pad or the like positioned between the mounting plate and the interior surface. In addition, the vacuum assembly may be provided with a sound-reducing cover, with one example being a cover made of a thermally-resistant plastic using a vacuum-forming process.

As best seen in FIG. 5, the motor housing 24 includes several other structural features which are particularly advantageous to a custodian or other user. For example, integrally molded right and left side handles 164*a,b* project outward from the right and left sidewalls 110, 112 respectively. These handles 164*a,b* are positioned at a height which is comfortable for most users, and enable a user to push, pull, turn, and otherwise steer the machine 10 with great ease. The top wall 114 of the motor housing 24 has several recesses 166 and upwardly extending projections 168, each of which is quite beneficial. For example, the recesses 166 provide storage space for any of a number of different kinds of containers and/or cleaning tools. Also, forward of the control panel 28, and adjacent each of the right and left sidewalls 110, 112, respectively, is an upwardly extending projection 168 which serves as a hose wrap or a cord wrap. In further detail, if desired, the left projection 168*a* may be used in connection with the wrap projection 56 on the left sidewall 36 of the fresh liquid tank 12, for storing a length of high pressure hose (not shown). At the same time, the right projection 168*b* may be used in combination with the projection 54 which extends outward from the right sidewall 34 of the fresh liquid tank 12, thereby forming upper and lower cord wraps for use in securely stowing a length of power cord (not shown). In addition, as best seen in FIG. 5, the top wall 114 of the motor housing 24 includes a pair of upwardly extending nubs 170 adjacent the back wall 108 of the housing 24. If desired, a user may take any suitable container or tool having a strap or cord of sufficient length, and releasably attach the particular piece to the machine simply by placing the cord over each of the upwardly projecting nubs 170.

Another version of the ergonomic multi-functional cleaning machine in accordance with the principles of the invention is shown in FIGS. 9-12. This cleaning machine 300 includes a fresh liquid tank 12, a waste recovery tank 14 positioned atop the fresh liquid tank 12, a vacuum source in the form of a vacuum assembly 16 for enabling a soil containing fluid to be vacuumed into the waste recovery tank 14, and a spigot assembly 44, with the spigot assembly 44 being operatively connected to the fresh liquid tank 12, whereby a user may regulate the flow of a liquid or solution from the fresh liquid tank 12.

The spigot assembly 44 includes a spigot 46 and a length of tubing (not shown), with the length of tubing fluidly connecting the spigot 46 to the interior of the fresh liquid tank 12. In addition, the machine 300 includes an extension handle 48, with the lower end of the handle 48 being connected to the spigot 46. Also, a motor housing 24 is mounted to the waste recovery tank 14. The motor housing 24 contains a vacuum assembly 16 (FIG. 12), and has a control panel 28 (FIG. 11) having a rocker switch 151 for turning the vacuum assembly 16 on and off.

With reference to FIGS. 9-12, the ergonomic multi-functional cleaning machine 300 includes many of the same structural elements, and therefore benefits, as those found in the cleaning machine 10 described above and illustrated in FIGS. 1-6. Therefore, the machine 300 will not be described in such extensive detail. However, for the benefit of the reader, it may be helpful to note a few examples of items which are included as a part of the machine 10, but which are not a part of the machine 300. Such examples include the pump assembly 18 and corresponding liquid lines and fittings, as well as the blower assembly 26.

Figure 13:
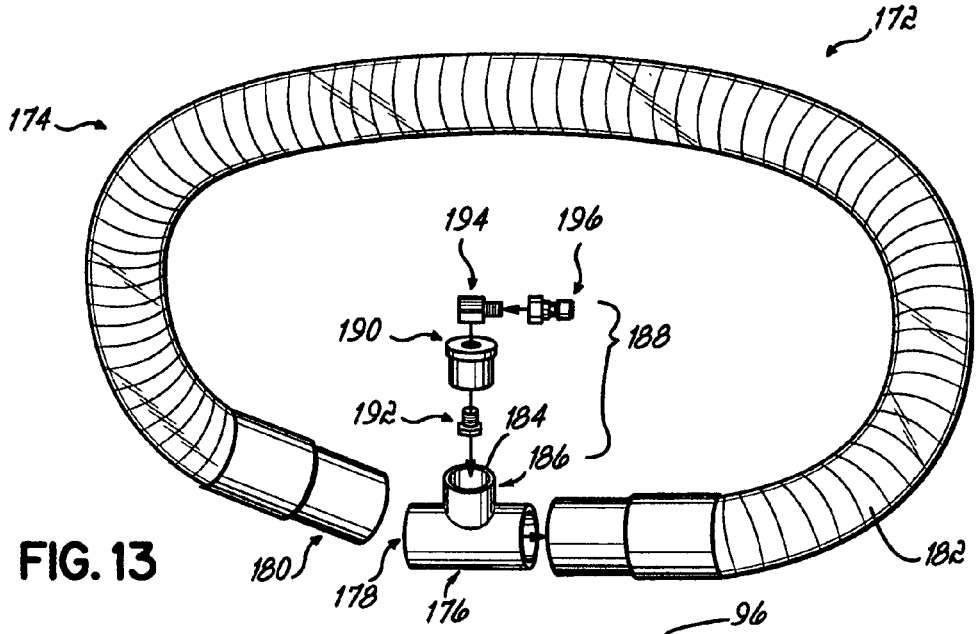
FIG. 13 is an elevated partially-disassembled view of a version of the inline wetting apparatus in accordance with the principles of the invention.
Figure 14:
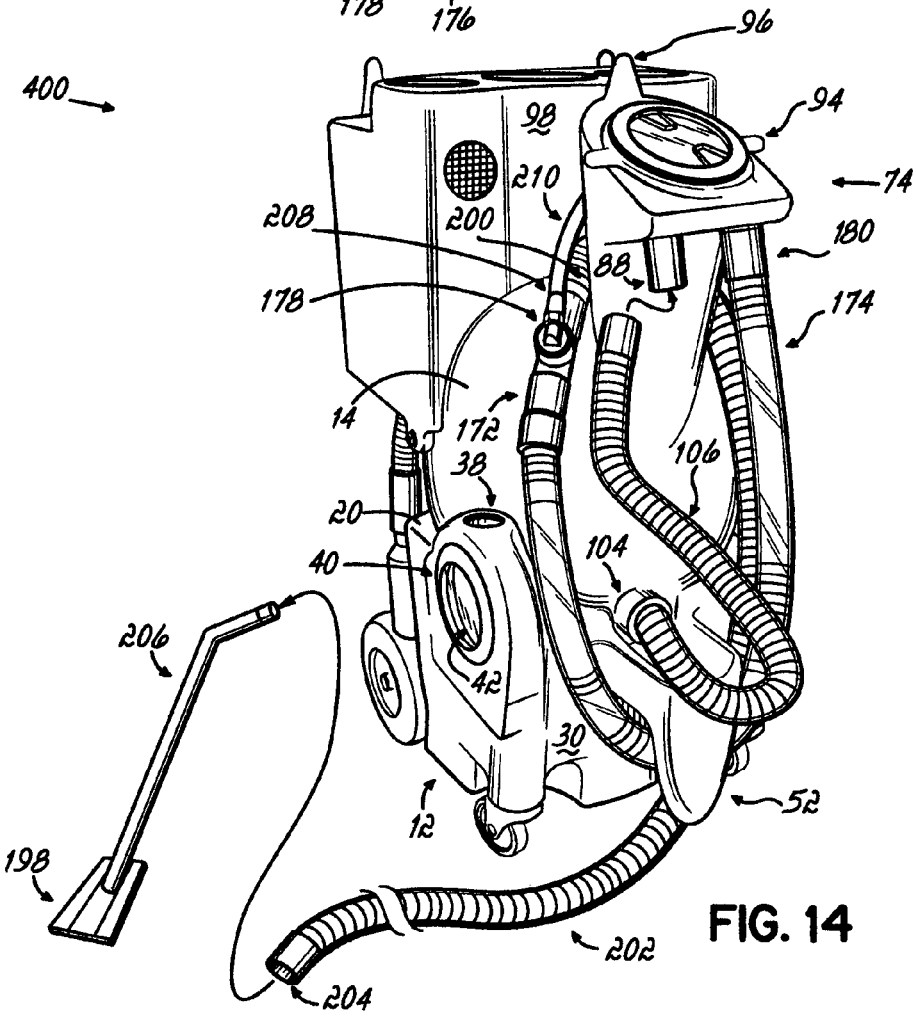
FIG. 14 is a perspective view of another version of the ergonomic multi-functional cleaning machine, including the inline wetting apparatus of FIG. 13, all in accordance with the principles of the invention.

With reference to FIGS. 13 and 14, an inline wetting apparatus 172 of the present invention is shown alone, and in combination with an ergonomic multi-functional cleaning machine 400 made in the accordance with the principles of the present invention. When the inline wetting apparatus 172 is connected to the machine 400, the apparatus 172 is capable of moistening or "wetting" dry soils, dirt, or other dry particles with a liquid- or solution-spray, aerosol, and/or vapor introduced from the machine 400. In this fashion, a worker may use the machine 400 (or any other suitable wet/dry vacuum machine) to vacuum up dry soils, dirt, or other dry particles.

With reference to FIG. 13, the inline wetting apparatus 172 includes tubing in the form of a length of vacuum hose 174 and a T-connector 176 which is releasably connectable to the length of vacuum hose 174. This tubing has a first end in the form of an inlet end 178 of the T-connector 176, and a second end in the form of an outlet end 180 of the vacuum hose 174. The tubing further includes a circumferential sidewall 182 defining an interior, and a rim in the form of the rim 184 of the radially extending tube extension 186 of the T-connector 176. The tube extension 186, including the rim 184, defines an opening in the circumferential sidewall 182, with the inlet end 178 being fluidly connectable to a cleaning tool, and the outlet end 180 being fluidly connectable to a waste recovery tank of a wet-dry vacuum machine. A spray assembly 188 is fluidly connectable to the tube extension 186 of the T-connector 176, as well as to a source of pressurized liquid or solution. Advantageously, this source of pressurized liquid may come from an ergonomic multi-functional cleaning machine of the present invention. The tube extension 186 and the complementary mounting structure tube are constructed and arranged so as to form a releasable friction fit with one another, thereby enabling a user to readily connect or disconnect the tube extension and the complementary mounting structure tube.

The spray assembly 188 includes a mounting member in the form of a tube 190 which is sized to form a frictional, yet releasable, fit with the tube extension 186 of the T-connector 176. The spray assembly tube 190 has a large opening (not shown) at its proximal end, and a small opening in an otherwise closed top wall at its distal end. The spray assembly 188 also includes a spray nozzle 192 which is connected to the tube 190, with the spray nozzle orifice oriented in the direction of the proximal end of the tube 190. If desired, the spray nozzle 192 may include a built-in filter (not shown). Both the tube 190 and nozzle 192 are sized so as to provide a suitable spray pattern in the soil-entrained fluid-flow-path of the T-connector 176. The opposite end of the spray nozzle 192 is secured to an elbow fitting 194 (or other suitable connector) positioned on the opposite side of the top wall of the spray assembly tube 190, with the elbow fitting 194 further being affixed to a male quick-disconnect member 196. In this fashion, an end of a pressure hose which is connected to a pressurized source of a liquid or solution easily may be releasably connected to the male quick-disconnect member 196, thereby providing the appropriate liquid or solution to the spray nozzle 192, for spraying into the interior of the T-connector 176. Both the fitting 194 and the member 196 are a part of the spray assembly 188.

The frictional fit feature of the inline wetting apparatus 172 is particularly beneficial to a user for several reasons. For example, a user easily may inspect, and if necessary clean, the orifice of the spray nozzle 192 and/or the interior of the T-connector 176 simply by separating the tube 190 from the radially extending tube extension 186 of the T-connector 176. Also, if desired, the particular spray nozzle 192 may have a fan-shaped spray pattern. In such a case, the spray assembly 188 may be constructed so that the fan pattern of the spray is oriented transversely to the longitudinal axis of the T-connector 176, when the spray assembly 188 is aligned so that the elbow fitting 194 and male quick-disconnect member 196 are aligned with the longitudinal axis of the T-connector 176. This feature is of tremendous benefit to a user, in that it allows a user to know the orientation of the fan-shaped spray pattern within the T-connector 176, simply by observing the orientation of the fittings 194, 196 which are on the exterior of the top wall of the tube 190, and if necessary, to rotate the spray assembly 188 in order to obtain the desired orientation of the spray pattern within the T-connector 176. A transverse orientation of such a fan-shaped spray pattern is advantageous, in that it assists in increasing the contact of the liquid or solution with the soil and/or other dry particles moving through the T-connector 176.

With regard to the length of vacuum hose 174, any suitable length may be used. This length of hose 174 provides an extended contact zone "downstream" from the T-connector 176 and spray assembly 188. The downstream contact zone is particularly beneficial, in that it enhances the process of bringing dry soils and/or other dry particles into solution with the liquid or solution being sprayed through the spray nozzle 192. The contact zone provides additional time for liquid- or solution-droplets, aerosol, and/or vapor to contact, and thereby "wet", the dry particles, thereby minimizing the chance that dry particles might enter the waste recovery tank 14 in an unwetted state. If desired, the length of the hose 174 may be at least about two feet. Also, if desired, the hose 174 may be about seven feet in length. Also, if desired, the hose 174 may be transparent or translucent.

FIG. 14 shows the ergonomic multi-functional cleaning machine 400 in dry vacuuming mode, with the inline wetting apparatus 172 in position, in the flow path from a dry vacuuming tool 198 to the waste recovery intake port tube 86. In further detail, the inlet end 178 of the T-connector 176 is connected to an outlet end 200 of a vacuum hose 202, with the inlet end 204 of the vacuum hose 202 being connected to a wand 206 and the dry vacuuming tool 198. The outlet end 180 of the vacuum hose 174 is fastened to the waste recovery intake port tube 86. The spray assembly 188 is secured to the T-connector 176, and an outlet end 208 of a length of liquid discharge line 210 is securely and releasably connected to the male quick-disconnect member 196 of the spray assembly 188. Although not shown in the Figure, the other end of the line 210 is fluidly connected to the liquid or solution in the fresh liquid tank 12, via the various components and connections described in detail above.

Also, as may be seen from the Figure, the vacuum hose 202 and the inline wetting apparatus 172 are oriented so that a portion of the vacuum hose 202 extends upward from the ground, along the surface of the waste recovery tank 14, where it connects to the apparatus 172. The apparatus vacuum hose 174 extends downward, passes beneath and around the wrap projection 52 extending from the front wall 30 of the fresh liquid tank 12, and then rises upward to the waste recovery intake port tube 86. This orientation is beneficial for several reasons. For example, the length of vacuum hose 174 is maintained in close proximity to the fresh liquid tank 12 and the waste recovery tank 14, and therefore, does not interfere with the movements of a user. Also, if a transparent or translucent hose is used, a user easily may see that the dry particles have been wetted and brought into solution prior to entering into the interior of the waste recovery tank 14. In addition, with this orientation, the vacuum hose 202/wetting apparatus 172 "tubing system" has, in essence, three centrifugal turns. These turns assist in the wetting process, in that the dirt particles and liquid or solution are forced against the interior sidewalls of the tubing system at these turns, due to centrifugal force. In doing so, the particles and liquid/solution are further mixed, thereby enhancing the process of bringing the dry soil particles into solution before such soils enter the waste recovery tank 14.

With the inline wetting apparatus 172, the machine 400 provides yet additional advantages. By bringing the dry particles into solution before they enter the waste recovery tank 14, the machine 400 enables a worker to perform bagless dry vacuuming; and because a filter bag is not used, the machine 400 avoids the suction power dropoff typical of traditional dry vacuuming systems. Moreover, the cost of filter bags is eliminated. Also, the dry vacuuming exhaust from the machine 400 has little to no dust, thereby maintaining ambient air quality for a custodian or other user.

The ergonomic multi-functional cleaning machines of the present invention may be made using any suitable commercially available materials and manufacturing techniques. For example, if desired, the fresh liquid tank 12, waste recovery tank 14, and motor housing 24 may be made of plastic, using rotational molding. Also, the inline wetting apparatus likewise may be made using suitable commercially available materials and techniques.

While the present invention has been illustrated by a description of various versions, and while the illustrative versions have been described in considerable detail, it is not the intention of the inventor to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the inventor's general inventive concept.

What is claimed is:

1. A cleaning machine, comprising:

a fresh liquid tank;

a waste recovery tank positioned atop the fresh liquid tank;

a vacuum source including a vacuum motor, the vacuum source enabling a soil-containing fluid to be vacuumed into the waste recovery tank;

a fresh liquid pump positioned above the fresh liquid tank, the fresh liquid pump enabling a liquid or solution to be pumped from the fresh liquid tank; and a motor housing connected to the waste recovery tank, the motor housing defining a motor-housing interior space, with the vacuum motor and the fresh liquid pump being positioned in the motor-housing interior space and mounted to the motor housing.

2. The cleaning machine of claim 1 wherein the motor housing includes a generally upwardly extending projection, and the fresh liquid tank includes a generally downwardly extending projection, the projections constructed and arranged to serve as upper and lower hose wraps, respectively.

3. The cleaning machine of claim 1 further including a blower motor, the blower motor positioned in the motor-housing interior space and mounted to the motor housing.

4. A cleaning machine, comprising:

a fresh liquid tank;

a waste recovery tank positioned atop the fresh liquid tank;

a vacuum source, the vacuum source enabling a soil-containing fluid to be vacuumed into the waste recovery tank;

a fresh liquid pump positioned above the fresh liquid tank, the fresh liquid pump enabling a liquid or solution to be pumped from the fresh liquid tank; and waste recovery intake structure, the waste recovery intake structure fluidly connected to, and extending generally upwardly from, the waste recovery tank.

5. The cleaning machine of claim 4 wherein the waste recovery intake structure is integrally connected to the waste recovery tank.

6. The cleaning machine of claim 4 wherein the waste recovery intake structure includes an upper portion fluidly connected to a lower portion, with the upper portion extending generally outwardly from the waste recovery tank.

7. The cleaning machine of claim 6 wherein the upper portion includes a waste recovery intake port.

8. The cleaning machine of claim 7 wherein the waste recovery intake port includes a tube, whereby, when the vacuum source is activated, a soil-containing fluid may flow upwardly through the tube, across an interior space of the upper portion, downwardly through the lower portion, and into the waste recovery tank.

9. The cleaning machine of claim 4 wherein the cleaning machine includes a front, the waste recovery intake structure generally positioned toward and at the front.

10. The cleaning machine of claim 9 further including a generally outwardly and downwardly extending projection positioned at the front, below the waste recovery intake structure, whereby the intake structure and the projection may serve as upper and lower hose wraps, respectively.

11. The cleaning machine of claim 4 wherein the waste recovery intake structure includes a circumferential sidewall defining an interior passage, the cleaning machine including a filter positioned in the interior passage.

12. A cleaning machine, comprising:

a fresh liquid tank;

a waste recovery tank positioned atop the fresh liquid tank;

a vacuum source, the vacuum source enabling a soil-containing fluid to be vacuumed into the waste recovery tank;

a fresh liquid pump positioned above the fresh liquid tank, the fresh liquid pump enabling a liquid or solution to be pumped from the fresh liquid tank; and a spigot fluidly connected to the fresh liquid tank, whereby a user may regulate the flow of a liquid or solution from the fresh liquid tank, the spigot including a selectively-adjustable valve which is operable between a fully open position and a fully closed position.

13. A cleaning machine, comprising:

a fresh liquid tank;

a waste recovery tank positioned atop the fresh liquid tank;

a vacuum source, the vacuum source enabling a soil-containing fluid to be vacuumed into the waste recovery tank;

a fresh liquid pump positioned above the fresh liquid tank, the fresh liquid pump enabling a liquid or solution to be pumped from the fresh liquid tank; and a spigot fluidly connected to the fresh liquid tank, whereby a user may regulate the flow of a liquid or solution from the fresh liquid tank, the cleaning machine including a back, with the spigot being at the back.

14. The cleaning machine of claim 13 further including an extension handle operatively connected to the spigot, the handle being elongated and extending upwardly from the spigot.

15. A cleaning machine, comprising:

a fresh liquid tank;

a waste recovery tank positioned atop the fresh liquid tank;

a vacuum source, the vacuum source enabling a soil-containing fluid to be vacuumed into the waste recovery tank;

a fresh liquid pump positioned above the fresh liquid tank, the fresh liquid pump enabling a liquid or solution to be pumped from the fresh liquid tank; and an inline wetting apparatus fluidly connectable to the waste recovery tank, the inline wetting apparatus comprising:

tubing having a first end, a second end, a circumferential sidewall defining an interior, and a rim defining an opening in the circumferential sidewall, the first end fluidly connectable to a cleaning tool, and the second end fluidly connectable to the waste recovery tank; and a spray assembly fluidly connectable to the rim of the tubing and to a source of pressurized liquid, the spray assembly including a spray nozzle and mounting structure, the spray assembly operable to direct a liquid through the spray nozzle into the interior of the tubing from a source of pressurized liquid, and the mounting structure releasably connectable to the rim of the tubing, thereby providing a user with access to the interior of the tubing via the opening defined by the rim when the mounting structure is disconnected from the rim, whereby a liquid from the spray nozzle and a plurality of soil particles passing through the tubing may come into contact.

16. The cleaning machine of claim 15 wherein the mounting structure and the rim are constructed and arranged to form a friction fit with each other, whereby a user readily may connect or disconnect the mounting structure and the rim.

17. The cleaning machine of claim 15 wherein the tubing includes a releasably connectable tube section, the releasably connectable tube section including the rim defining the opening in the circumferential sidewall.

18. The cleaning machine of claim 15 wherein at least a portion of the tubing is flexible.

19. The cleaning machine of claim 15 wherein at least a portion of the tubing is transparent.

20. The cleaning machine of claim 15 wherein the source of pressurized liquid includes the fresh liquid tank and the fresh liquid pump.

21. A cleaning machine, comprising:

a fresh liquid tank;

a waste recovery tank positioned atop the fresh liquid tank;

a vacuum source, the vacuum source enabling a soil-containing fluid to be vacuumed into the waste recovery tank; and a spigot operatively connected to the fresh liquid tank, whereby a user may regulate the flow of a liquid or solution from the fresh liquid tank, the spigot including a selectively-adjustable valve which is operable between a fully open position and a fully closed position.

22. A cleaning machine, comprising:

a fresh liquid tank;

a waste recovery tank positioned atop the fresh liquid tank;

a vacuum source, the vacuum source enabling a soil-containing fluid to be vacuumed into the waste recovery tank; and a spigot operatively connected to the fresh liquid tank, whereby a user may regulate the flow of a liquid or solution from the fresh liquid tank, the cleaning machine including a back, and the spigot being at the back.

23. The cleaning machine of claim 22 further including an extension handle operatively connected to the spigot, the handle being elongated and extending upwardly from the spigot.

24. A cleaning machine, comprising:

a fresh liquid tank;

a waste recovery tank positioned atop the fresh liquid tank;

a vacuum source, the vacuum source enabling a soil-containing fluid to be vacuumed into the waste recovery tank;

a spigot operatively connected to the fresh liquid tank, whereby a user may regulate the flow of a liquid or solution from the fresh liquid tank, and a motor housing connected to the waste recovery tank, the motor housing defining a motor-housing interior space, the vacuum source including a vacuum motor positioned in the motor-housing interior space and mounted to the motor housing, the motor housing including a generally upwardly extending projection, and the fresh liquid tank including a generally downwardly extending projection, the projections being constructed and arranged to serve as upper and lower hose wraps, respectively.

25. A cleaning machine, comprising:

a fresh liquid tank;

a waste recovery tank positioned atop the fresh liquid tank;

a vacuum source, the vacuum source enabling a soil-containing fluid to be vacuumed into the waste recovery tank;

a spigot operatively connected to the fresh liquid tank, whereby a user may regulate the flow of a liquid or solution from the fresh liquid tank; and waste recovery intake structure, the waste recovery intake structure fluidly connected to, and extending generally upwardly from, the waste recovery tank.

26. The cleaning machine of claim 25 wherein the waste recovery intake structure is integrally connected to the waste recovery tank.

27. The cleaning machine of claim 25 wherein the waste recovery intake structure includes an upper portion fluidly connected to a lower portion, with the upper portion extending generally outwardly from the waste recovery tank.

28. The cleaning machine of claim 27 wherein the upper portion includes a waste recovery intake port.

29. The cleaning machine of claim 28 wherein the waste recovery intake port includes a tube, whereby, when the vacuum source is activated, a soil-containing fluid may flow upwardly through the tube, across an interior space of the upper portion, downwardly through the lower portion, and into the waste recovery tank.

30. The cleaning machine of claim 25 wherein the cleaning machine includes a front, the waste recovery intake structure generally positioned toward and at the front.

31. The cleaning machine of claim 30 further including a generally outwardly and downwardly extending projection positioned at the front, below the waste recovery intake structure, whereby the intake structure and the projection may serve as upper and tower hose wraps, respectively.

32. The cleaning machine of claim 25 wherein the waste recovery intake structure includes a circumferential sidewall defining an interior passage, the cleaning machine including a filter positioned in the interior passage.

33. A cleaning machine, comprising:

a fresh liquid tank;

a waste recovery tank positioned atop the fresh liquid tank;

a vacuum source, the vacuum source enabling a soil-containing fluid to be vacuumed into the waste recovery tank;

a spigot operatively connected to the fresh liquid tank, whereby a user may regulate the flow of a liquid or solution from the fresh liquid tank; and an inline wetting apparatus fluidly connectable to the waste recovery tank, the inline wetting apparatus comprising:

tubing having a first end, a second end, a circumferential sidewall defining an interior, and a rim defining an opening in the circumferential sidewall, the first end fluidly connectable to a cleaning tool, and the second end fluidly connectable to the waste recovery tank; and a spray assembly fluidly connectable to the rim of the tubing and to a source of pressurized liquid, the spray assembly including a spray nozzle and mounting structure, the spray assembly operable to direct a liquid through the spray nozzle into the interior of the tubing from a source of pressurized liquid, and the mounting structure releasably connectable to the rim of the tubing, thereby providing a user with access to the interior of the tubing via the opening defined by the rim when the mounting structure is disconnected from the rim, whereby a liquid from the spray nozzle and a plurality of soil particles passing through the tubing may come into contact.

34. The cleaning machine of claim 33 wherein the mounting structure and the rim are constructed and arranged to form a friction fit with each other, whereby a user readily may connect or disconnect the mounting structure and the rim.

35. The cleaning machine of claim 33 wherein the tubing includes a releasably connectable tube section, the releasably connectable tube section including the rim defining the opening in the circumferential sidewall.

36. The cleaning machine of claim 33 wherein at least a portion of the tubing is flexible.

37. The cleaning machine of claim 33 wherein at least a portion of the tubing is transparent.

38. An inline wetting apparatus for use with a wet-dry vacuum machine, the inline wetting apparatus comprising:

tubing having a first end, a second end, a circumferential sidewall defining an interior, and a rim defining an opening in the circumferential sidewall, the first end fluidly connectable to a cleaning tool, and the second end fluidly connectable to a waste recovery tank of a wet-dry vacuum machine; and a spray assembly fluidly connectable to the rim of the tubing and to a source of pressurized liquid, the spray assembly including a spray nozzle and mounting structure, the spray assembly operable to direct a liquid through the spray nozzle into the interior of the tubing from a source of pressurized liquid, and the mounting structure releasably connectable to the rim of the tubing, thereby providing a user with access to the interior of the tubing via the opening defined by the rim when the mounting structure is disconnected from the rim, whereby a liquid from the spray nozzle and a plurality of soil particles passing through the tubing may come into contact.

39. The inline wetting apparatus of claim 38 wherein the mounting structure and the rim are constructed and arranged to form a friction fit with each other, whereby a user readily may connect or disconnect the mounting structure and the rim.

40. The inline wetting apparatus of claim 38 wherein the tubing includes a releasably connectable tube section, the releasably connectable tube section including the rim defining the opening in the circumferential sidewall.

41. The inline wetting apparatus of claim 38 wherein at least a portion of the tubing is flexible.

42. The inline wetting apparatus of claim 38 wherein at least a portion of the tubing is transparent.

* * * * *